United States Patent [19]

Nilsen

[11] 4,141,486

[45] Feb. 27, 1979

[54] COLLAPSIBLE SIDE WALLS FOR A PACKING CASE

[76] Inventor: Tor N. Nilsen, Østrevei 25, 3150 Tolvsrod, Nørway

[21] Appl. No.: 841,444

[22] Filed: Oct. 12, 1977

[30] Foreign Application Priority Data

Apr. 4, 1977 [DE] Fed. Rep. of Germany ... 7710703[U]

[51] Int. Cl.[2] ..... B65D 9/32

[52] U.S. Cl. ..... 229/23 C; 16/150

[58] Field of Search ..... 229/23 C; 150/46, 19, 150/21, 24, 7; 16/150

[56] References Cited

U.S. PATENT DOCUMENTS

| | | | |
|---|---|---|---|
| 1,990,871 | 2/1935 | Klocke | 16/150 X |
| 2,210,652 | 8/1940 | Demmett | 16/150 X |
| 2,520,303 | 8/1950 | Bauer | 229/23 C |
| 2,693,894 | 11/1954 | Elmendorf | 229/23 C |
| 2,706,063 | 4/1955 | Muller | 229/23 CX |
| 2,958,363 | 11/1960 | Ware, Jr. | 229/23 CX |
| 3,458,242 | 7/1969 | Williams | 16/150 X |
| 4,027,714 | 6/1977 | Dixon et al. | 16/150 |

*Primary Examiner*—Davis T. Moorhead
*Attorney, Agent, or Firm*—Young & Thompson

[57] ABSTRACT

The present invention relates to collapsible side walls for a packing case, consisting of four wall sections hinged together at the side edges. The side walls are primarily intended to be used in connection with a cover and a bottom, for packing goods, e.g. bulk freight or small single items, which are to be transported on pallets. Each wall section consists of two facing plates being mutually spaced by means of parallel, mutually spaced ribs. The hinge at the side edges of each wall section is formed from a strip of pliable material whose longitudinal edges are secured in the slot between the plates of the wall sections.

3 Claims, 3 Drawing Figures

COLLAPSIBLE SIDE WALLS FOR A PACKING CASE

Figure 1:
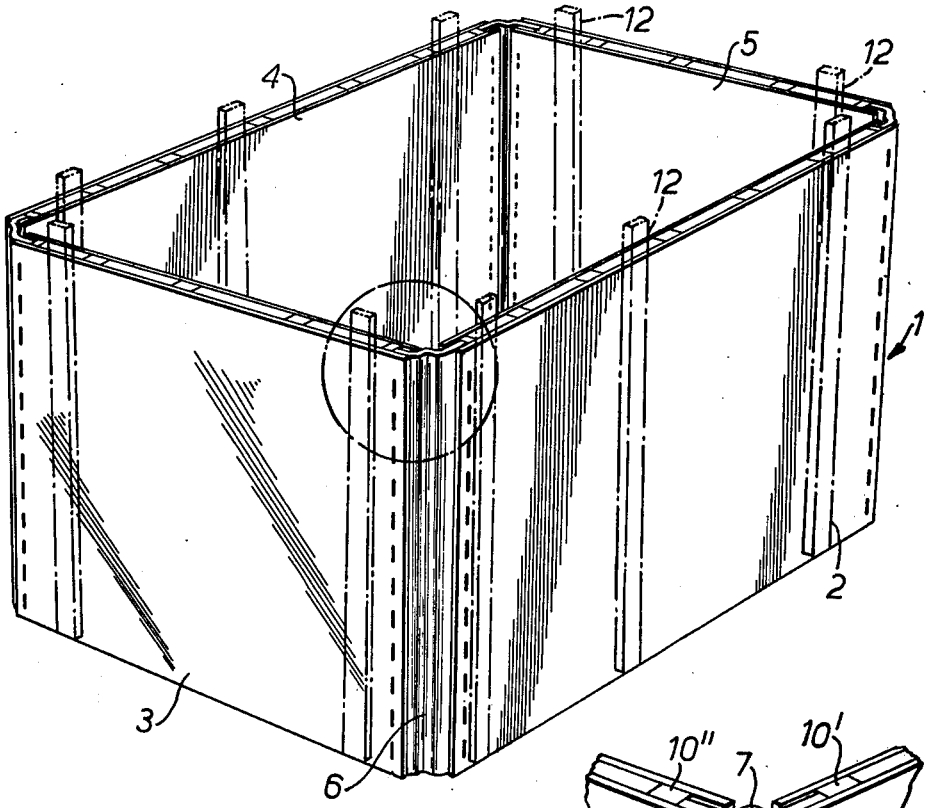

Pallets are used to a very great extent in modern transportation systems for goods. The advantage of transporting goods in this way is that the pallet is constructed such that it raises the goods slightly above the foundation of the transportation means, such that there is room to come in underneath the pallet with lifting equipment, e.g., a fork lift. The pallet thus also helps to stiffen the packing case, so that it is not damaged by the lifting equipment. Large items, for example, refrigerators, stoves, furniture and the like, can be secured to a container by means of straps, but bulk freight (chemicals, valuable ores, etc.) and smaller items must be packed in cases on the pallet. The packing cases must be strong enough to tolerate stacking, as several such pallets with cargo are stacked on top of one another when they are being transported. The walls of the packing case must thus have a certain resistance to buckling so that the packing case will have sufficient stacking strength. Previously, such walls have been constructed from various kinds of materials which resist buckling, e.g., corrugated metal, plywood sheets or layers of wood nailed together. For lightweight cargo, solid multi-layer corrugated cardboard has been used.

Walls of the former type are quite expensive, while walls of the latter type are suitable only for use with lightweight cargo.

The purpose of the invention is to provide collapsible side walls for packing cases of the above type which have great resistance to buckling, making them suitable for use with heavy freight, and which also are inexpensive to produce.

This is achieved according to the invention with side walls of the type described above, the walls being characterized in that each wall section consists of two facing plates, the facing flat sides being held mutually spaced by means of parallel, mutually spaced ribs, and in that the hinge at the side edges of each wall is formed from a strip of pliable material whose longitudinal edges are secured in the slot between the two plates in the wall sections. The plates are preferably made of fiberboard, as these plates are inexpensive and are rigid enough to resist buckling. The hinge strips are preferably made of kraft cardboard which is provided with a central, longitudinal fold groove. The hinge strips can be attached in a simple manner to the wall surfaces by means of through-going, U-shaped staples.

Using the walls according to the invention, it is also quite simple to increase the height of a container, if this is desired. For example, let us say that one is using standard containers of 40 cm and 60 cm height, and a need arises for a few 100 cm high containers. To order containers or container walls for this special height would be unreasonably expensive if only a relatively limited number of containers of this height were needed. With the walls of the invention, however, it is a very simple and safe process to splice together walls of 60 cm height with walls of 40 cm height, thus obtaining a container having walls 100 cm high. This is done quite simply with the invention by inserting additional ribs, having the same dimensions as the ribs used between the facing plane sides of each wall section, down into the space between the two facing sides. The splicing ribs are somewhat longer than the ribs used elsewhere in the wall section, extending up over the upper edge of the container walls by, for example, one inch. In other words, the container walls which are to be placed at the bottom, directly on the pallet, will have pegs extending up centrally in their walls. Another set of container walls can then be placed on top of the bottom set of walls, the pegs on the lower set of walls then extending up into the space between the plates on the upper set of container walls. In this manner, one obtains a simple, inexpensive and reliable joint between the two sets of walls which are joined together vertically.

The invention will be explained in more detail in the following with reference to the figures.

FIG. 1 shows the collapsible side walls of the invention in perspective.

Figure 1A:
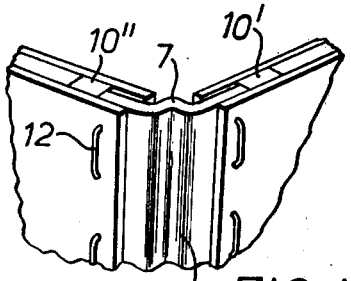

FIG. 1*a* shows an enlarged view of the corner detail encircled in FIG. 1.

Figure 2:
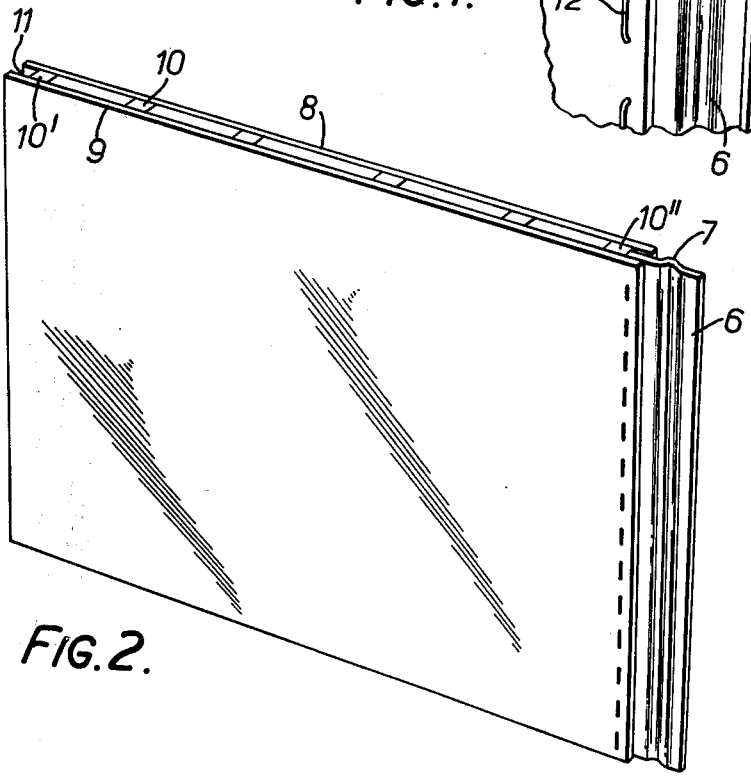

FIG. 2 shows a single wall section with a hinge strip attached thereto.

The collapsible side walls 1 of the invention consist of four wall sections 2, 3, 4, 5, whose side edges are hinged together to the coincident side edges of adjacent sections by pliable strips 6 of kraft cardboard, for example, said strips being provided with a central, longitudinal fold groove 7.

Each of the wall sections 2, 3, 4, 5 consists of two plates 8 and 9, preferably made of fiberboard. Flat sides of the plates 8, 9 in each wall section are arranged so as to be facing, and are held mutually spaced by means of wooden ribs 10, which are glued to the facing sides of the plates 8, 9. The two outer ribs 10' and 10'' are attached a small distance inside the side edges of the plates 8, 9. In this way, an outwardly-open slot 11 is formed at the side edges of each wall section. The longitudinal edges of the hinge strips 6 are guided into the slot and are secured in this position by means of heavy-duty U-shaped staples 12.

Because the respective wall sections 2, 3, 4, 5 are hinged together, the wall sections can be folded flat. As a rule, when the packing case is in use, the walls will be fitted into a solid bottom with upturned edges which is fastened to the top side of the pallet. A cover will also be provided for the packing case, the cover, like the bottom, having edges which in this case extend down around the upper part of the walls of the packing case.

As indicated by the dotted-dashed lines on FIG. 1, a number of additional ribs 12 can be inserted down between the plates 8 and 9. These ribs 12 preferably have the same thickness as the ribs 10 between the plates 8 and 9, but their length is somewhat greater than the height of the walls 2, 3, 4 and 5. Therefore, these ribs will extend a small distance, say one inch, above the upper edge of the collapsible side walls. A new set of callapsible walls consisting of four wall sections hinged together, can then be placed on top of the first set of walls in order to make a higher container.

Having described my invention, I claim:

1. Collapsible side walls for a packing case, consisting of four wall sections which are hinged together at the side edges, characterized in that each wall section 2, 3, 4, 5 consists of two facing rigid fiberboard plates 8, 9, the facing flat sides of each section being held mutually spaced by means of parallel, mutually spaced vertical ribs 10, 10', 10'', and in that the hinge at the side edges of each wall section is formed from a strip of pliable material whose longitudinal edges are secured in the slot 11 between the plates 8, 9 of the wall sections 2, 3, 4, 5.

2. Collapsible side walls according to claim 1, in which the horizontal distance between said vertical ribs is substantially greater than the width of said ribs.

3. Collapsible side walls according to claim 1, in which the two outer said ribs are attached a small distance inside the side edges of the plates to define the bottoms of said slots and said strip of pliable material abuts said outer ribs in said slots.

* * * * *